US005833362A

United States Patent [19]

Shepard

[11] Patent Number: 5,833,362

[45] Date of Patent: Nov. 10, 1998

[54] BEVERAGE BLENDER

[76] Inventor: James Shepard, 12700 S.W. 11th Ct., Davie, Fla. 33325

[21] Appl. No.: 852,133

[22] Filed: May 6, 1997

[51] Int. Cl.[6] ..... B01F 11/00

[52] U.S. Cl. ..... 366/111; 366/212; 366/240

[58] Field of Search ..... 366/108, 110, 366/111, 112, 114, 116, 197, 202, 208, 209, 210, 212, 218, 219, 237, 239, 240

[56] References Cited

U.S. PATENT DOCUMENTS

| | | | |
|---|---|---|---|
| 1,138,457 | 5/1915 | Dahlmeyer | 366/114 |
| 1,607,811 | 11/1926 | Blum | 366/110 |
| 1,908,104 | 5/1933 | Bell | 366/111 |
| 1,947,398 | 2/1934 | Stuhler | 366/111 |
| 2,247,978 | 7/1941 | Van Arkel | 366/110 |
| 2,356,004 | 8/1944 | Price | 366/110 |
| 2,610,040 | 9/1952 | Emmons | 366/111 |
| 2,660,414 | 11/1953 | Von Ludwig | 366/116 |
| 3,157,389 | 11/1964 | Williams | 366/114 |
| 3,281,125 | 10/1966 | Shoe et al. | 366/111 |
| 3,353,796 | 11/1967 | Roberts | 366/111 |
| 3,417,966 | 12/1968 | Bodine | 366/116 |
| 3,552,068 | 1/1971 | Van Fossen | 366/111 |
| 3,587,193 | 6/1971 | Lewis | 366/111 |
| 3,640,508 | 2/1972 | Reibig | 366/116 |
| 4,398,829 | 8/1983 | Shick | 366/114 |

FOREIGN PATENT DOCUMENTS

| | | | |
|---|---|---|---|
| 560855 | 10/1931 | Germany | 366/110 |
| 406222 | 7/1974 | U.S.S.R. | 366/111 |
| 97708 | 8/1977 | U.S.S.R. | 366/114 |
| 676352 | 7/1952 | United Kingdom | 366/111 |

*Primary Examiner*—Tony G. Soohoo
*Attorney, Agent, or Firm*—Malloy & Malloy, P.A.

[57] ABSTRACT

A beverage blender including a beverage support section and a base section, the beverage support section positioned in spaced-apart relation above the base section by at least one support structure disposed therebetween. The support structure maintains the beverage support section in the spaced-apart relation above the base section while also permitting relative movement between the beverage support section and the base section, the relative movement including a high frequency, low turbulence vibration of the beverage support section such that a beverage container positioned atop the beverage support section is correspondingly vibrated to thoroughly blend its contents. Additionally, a containment portion is disposed on the beverage support section to retain the beverage container thereon.

23 Claims, 6 Drawing Sheets

BEVERAGE BLENDER

BACKGROUND OF THE INVENTION

1. Field of Invention

The present invention relates to a beverage blender structured to thoroughly mix liquid and particulate flavorings added to a beverage so as to homogeneously disperse the flavorings throughout the beverage without requiring the use of a spoon, fork, straw, stirrer, or any other object to be placed inside the beverage. Additionally, the beverage blender is structured to work in conjunction with most cups, glasses, or other standard beverage containers so as to avoid having a beverage transferred to another container for mixing and further avoid the necessity of having a cap or cover placed on the beverage container before mixing.

2. Description of the Related Art

A number of restaurants, coffee and donut shops, and even convenience stores offer a wide variety of beverages to their patrons. With the exception of soft drinks, most beverages require the server to add some additional flavorings such as sugar, cream, milk, hot chocolate, instant coffee crystals, powdered creamer, and the like. In most of these beverages, therefore, it is necessary to thoroughly mix the added flavorings so that they are homogeneously dispersed throughout the beverage. In the past, such mixing has been accomplished manually by requiring that a spoon, straw, stirrer, or other object be placed inside the beverage and stirred in a generally circular motion. Unfortunately, in light of the hectic and rushed environment in many commercial eateries, the manual stirring of additional flavorings into beverages has not proven to be very practical. Waitstaff frequently are in such a rush to mix a beverage that the stirring motion causes the beverage to splash or spill over the top of the container. To compensate for this, it is not unusual for waitstaff to underfill the beverage containers while mixing, and then subsequently top off the beverage container.

Perhaps more importantly, however, it is seen that conventional blending techniques can often be unsanitary. For example, if a reusable item is employed, in order to maintain sanitary conditions and prevent the spread of germs and bacteria, the spoon, fork, stirrer, or other utensil utilized to mix the beverage must be completely washed after each use. Alternatively, however, many establishments utilize disposable stirrers in order to eliminate the time-consuming step of washing a spoon, or other stirrer after each use. In this type of circumstance the stirrers are typically contained in a box with a large number of stirrers such that an individual may merely reach in and grab a stirrer. Of course, however, it is an all to frequent occurrence that an individual getting a stirrer has dirty hands, such as at a construction sight, and as they grab one stirrer, they touch and potentially contaminate a large number of additional stirrers. Moreover, they may contaminate their own stirrer if it is not handled properly.

Additionally, the process of utilizing disposable stirrers naturally leads to the consumption of a large number of stirrers per day. For example, waitstaff in coffee shops, restaurants, bars, and other commercial establishments, as well as the self service consumers, typically prepare a very large quantity of drinks per hour. As such, it is seen that the use of disposable stirrers is very uneconomical. Additionally, since disposable stirrers are typically constructed of a non-biodegradable material such as plastic or rigid vinyl, for example, they are seen to be environmentally destructive. Since there still is no economically feasible method of recycling beverage stirrers, the waste of resources and environmental damage due to non-biodegradable beverage stirrers is particularly acute.

In the past, others have utilized electric mixers, food processors, blenders, and similar appliances for mixing quantities of liquids such as sauces, puddings, and the like. These devices operate by spinning a utensil rapidly through the liquid. The utensil utilized for such mixing typically resembles an eggbeater, blender blades, spring mixer, and the like. Furthermore, the blade or other mixing apparatus of existing devices must be washed and cleaned regularly since they are in direct contact with the beverage. Larger devices such as tabletop blenders and food processors require use of a particular container with the device and are not structured to mix the contents of an individual serving of a beverage such as from a glass, cup, or mug, for example. This adds the further inconvenience of having to wash the device's container in addition to washing the individual serving container. Although smaller hand-held mixers may sometimes be utilized directly with the individual serving containers, these hand-held devices cause considerable splashing and spilling of the contents of a beverage container. Naturally, they also require a separate utensil such as a blade to be inserted into the beverage to be mixed. In addition to increasing the risk of spilling or splashing the beverage, the blade or other utensil typically has a quantity of beverage which drips away from it after the blade or utensil is removed from the beverage, frequently leaving a messy trail behind it. As a further inconvenience, the blade or other utensil used for mixing must be washed separately after each use.

It is also seen that due to the high degree of agitation caused by many existing mixers, blenders, food processors, and the like, they are not structured towards mixing beverages within open containers, and therefore require that a cap or cover be secured before mixing begins, or that the beverage be poured into a special container adapted for use with the device. When existing mixers, blenders, and food processors are utilized with individual serving containers or open containers, for example, there is considerable spillage and splashing of the beverage.

Accordingly, there still remains a significant need in the art for a beverage blender which can thoroughly and automatically mix liquid and particulate flavorings added to a beverage in a standard open container, such as a glass or coffee mug, without requiring any utensils to be placed inside the beverage, and thus eliminating the need to utilize a disposable utensil, or wash a spoon, fork, stirrer, or other mixing utensil for the preparation of the beverage, as well as the risk of contamination from previously handled utensils. Moreover, there is a need for such a beverage blender which utilizes high frequency, low-turbulence vibrations so as to thoroughly mix the contents of an open beverage container without spilling or splashing the contents.

SUMMARY OF THE INVENTION

The present invention relates to a beverage blender capable of thoroughly mixing liquid and particulate flavorings added to a beverage in a standard open container such as a glass or coffee mug without requiring any utensils to be placed inside the beverage.

The beverage blender of the present invention includes a beverage support section positioned in a spaced-apart generally horizontal relation above a base section. Moreover, a containment portion is disposed on the beverage support section and is structured to retain a beverage container thereon.

At least one support structure is positioned between the beverage support section and the base section. The support structure is configured so as to maintain the beverage support section in a spaced-apart distance above the base section and permit the beverage support section to move relative to the base section. To this result, the beverage blender will include means for vibrating the beverage support section in relation to the base section. The resultant vibration is structured to be a high frequency agitation sufficient to thoroughly mix the contents of a beverage container disposed on the beverage support section, without substantial risk of spillage. The beverage blender further includes powering means in order to provide operating power to the means for vibrating the beverage support section.

It is an object of the present invention to provide a beverage blender structured to thoroughly mix liquid and particulate flavorings added to a beverage so as to homogeneously disperse the flavorings throughout the beverage.

Another object of the present invention is to provide a beverage blender which eliminates the need to have a spoon, fork, straw, stirrer, or other object placed inside the beverage, and thus reduces the transfer of germs and bacteria into a beverage.

An additional object of the present invention is to provide a beverage blender which works in conjunction with most cups, glasses, or other standard beverage containers so as to avoid having to transfer a beverage to another container for mixing.

It is also an object of the present invention to provide a beverage blender which eliminates the need to have a person manually stir or mix a drink.

A further object of the present invention is to provide a beverage blender structured to reduce waste by eliminating the need for disposable mixing utensils such as spoons, forks, straws, and stirrers, for example, to be used to mix beverages.

It is also an object of the present invention to provide a beverage blender structured to reduce the risk of accidental spillage or splashing of a beverage by eliminating the need for manual mixing of beverages.

Yet another object of the present invention is to provide a beverage blender which utilizes high frequency, low-turbulence vibrations so as to thoroughly mix the contents of an open beverage container without spillage or splashing.

These and other objects, features, and advantages of the present invention will become more readily apparent from the attached drawings and the detailed description of the preferred embodiments, which follow.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Shown throughout the Figures, the present invention is directed towards a beverage blender, generally indicated as 10. The beverage blender of the present invention is structured to thoroughly mix liquid and particulate flavorings added to a beverage, in an open container, so as to homogeneously disperse the flavorings throughout the beverage.

Figure 1:
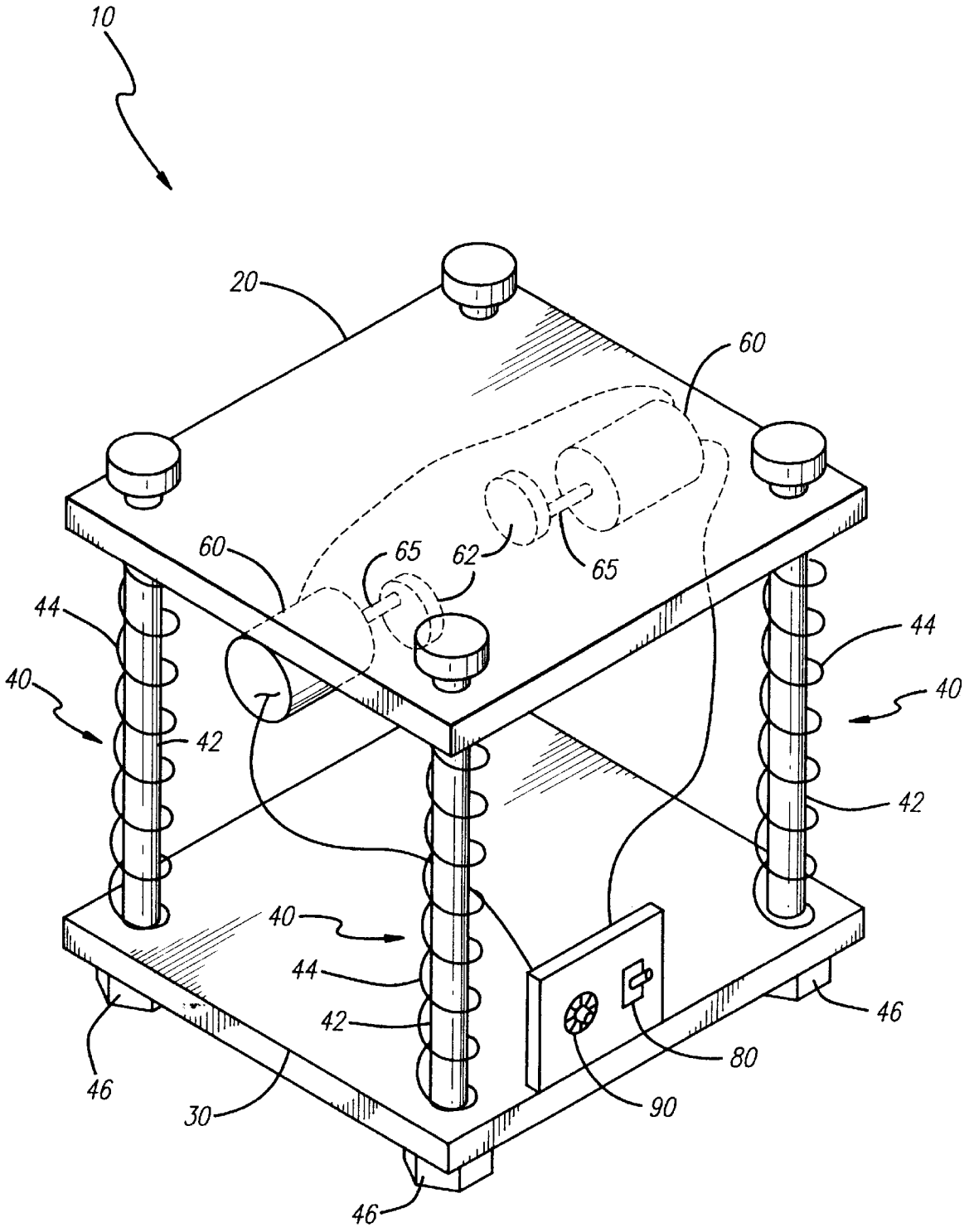
FIG. 1 is a perspective view of an embodiment of the beverage blender without side walls.

The beverage blender 10 of the present invention preferably includes a beverage support section 20, as shown in the figures, which may be formed in a wide variety of shapes and sizes, and from a variety of materials without departing from the nature of the present invention. In the preferred embodiment, as best shown in FIG. 1, however, the beverage support section 20 is generally shaped as a rectangular plate.

Figure 3:
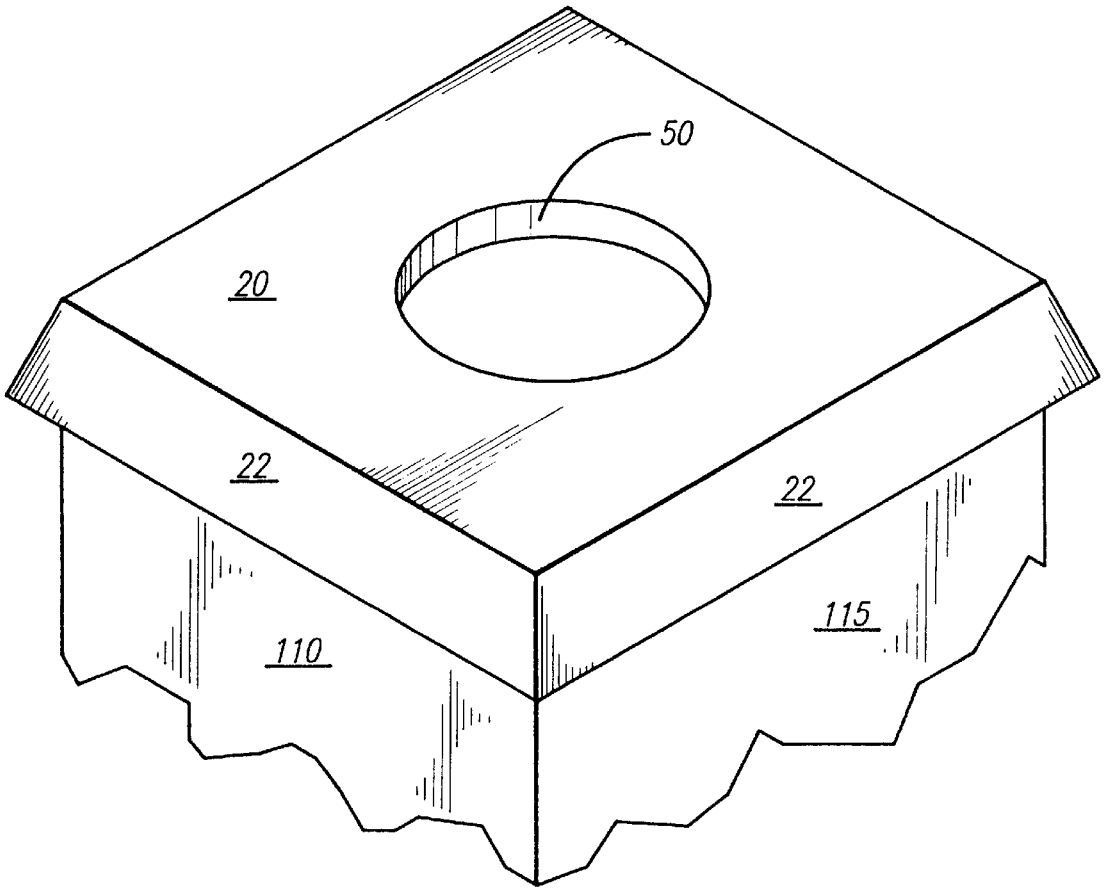
FIG. 3 is a perspective view of a second alternative embodiment of the beverage blender showing the beverage support section with an overhanging portion structured to direct accidental spillage away from the beverage blender.

Looking to the embodiment of FIG. 3, the beverage support section 20 includes an overhanging portion 22. The overhanging portion 22 is structured to direct any accidental spillage away from an interior of the beverage blender 10, where the internal components are contained, so as to substantially decrease the chances of a short circuit, possible electrical shock to a user, and/or damage and other corrosion to the device.

Figure 2:
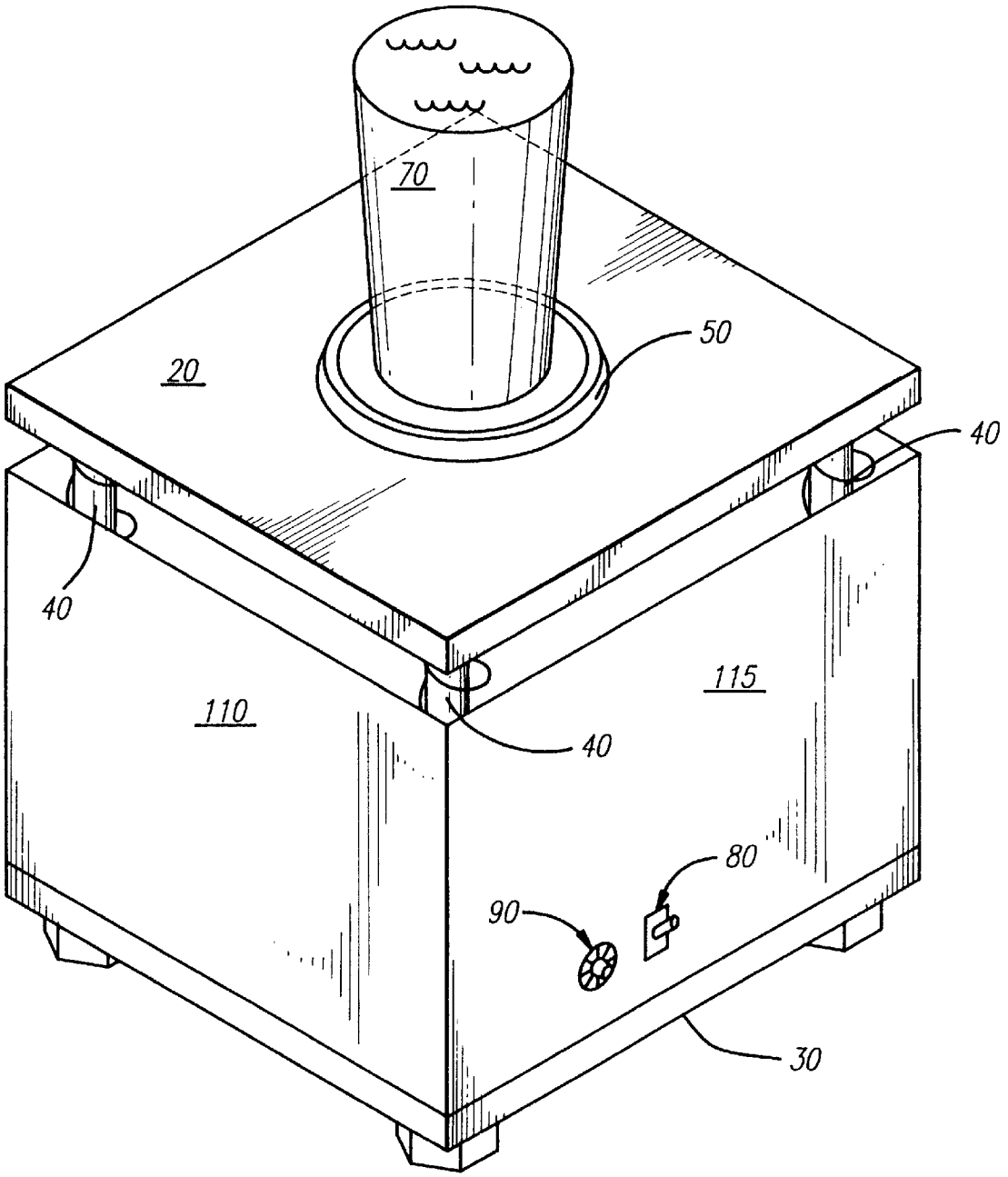
FIG. 2 is a perspective view of a first alternative embodiment of the beverage blender with side walls in place.

Additionally the beverage support section 20 of the present invention preferably includes a containment portion 50. The containment portion 50 is structured to retain a beverage container 70 therein and prevent excessive movement of the beverage container 70 on the beverage support section 20. Of course the containment portion 50 may be formed in a wide variety of configurations, however, in the preferred embodiment, the containment portion 50 is structured as a ring extending upwards from the beverage support section 20, as shown in FIG. 2. This ring will generally abut the beverage container and will prevent its movement off of the beverage support section. Moreover, as the beverage container 70 will generally be placed on the beverage support section in a filled state, minimal risk of tip over the ring is evidenced. Alternatively, as shown in FIG. 3, the containment portion 50 may be configured to be a generally circular indentation in the beverage support section 20. It is seen that other embodiments may also be utilized without departing from the present invention and the actual configuration of the ring or indentation in a circular form is not necessary, as other configurations can be effectively utilized so long as they provide a generally contained area from which the beverage container 70 can not slide out.

Figure 4:
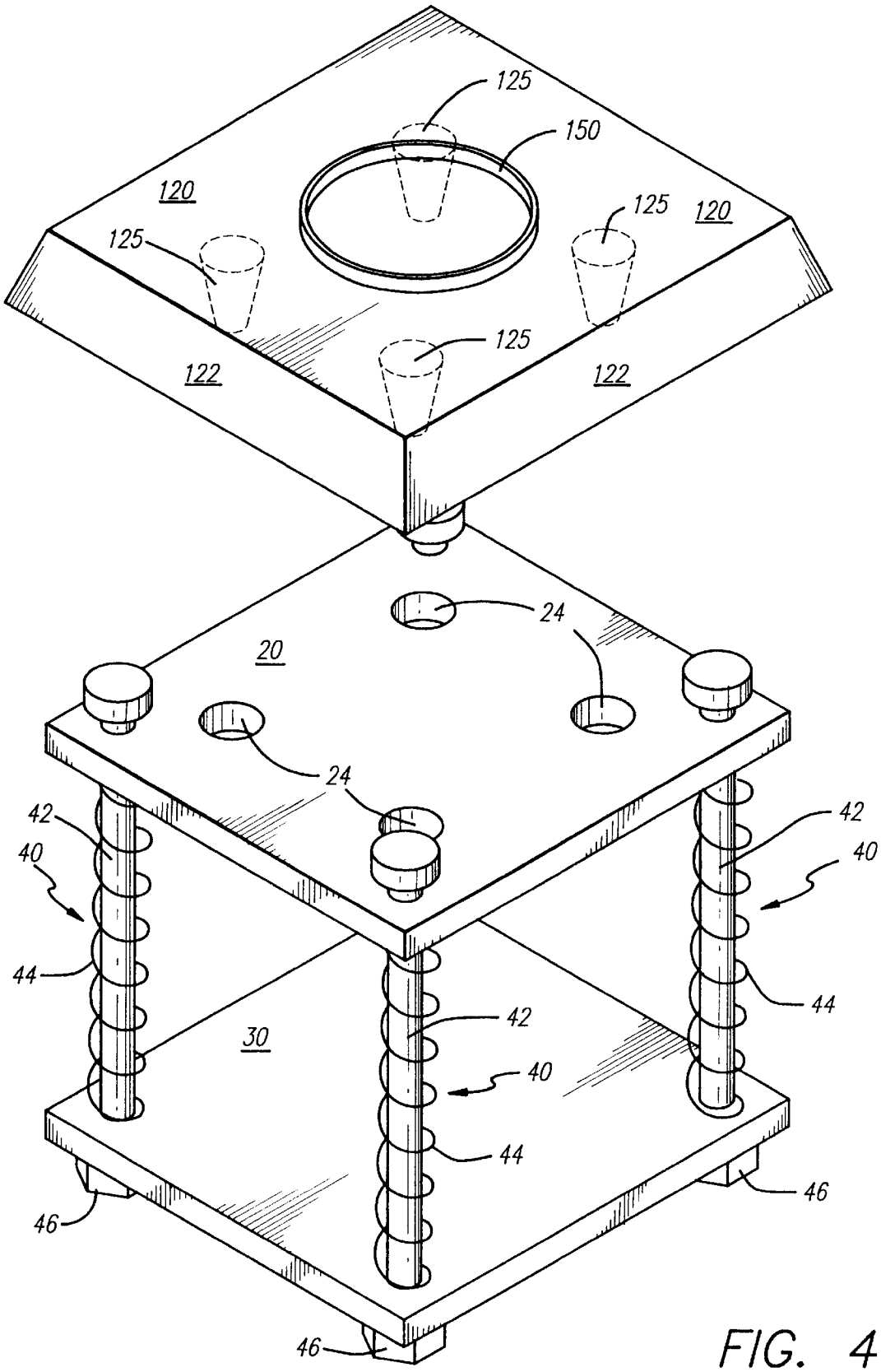
FIG. 4 is a perspective view of a third alternative embodiment of the beverage blender which utilizes a removable upper liner as shown.

In one alternative embodiment, the beverage blender 10 includes an upper liner 120 structured to be positioned on top of the beverage support section 20, as shown in FIG. 4. The upper liner 120 is preferably structured to be easily removable, thereby substantially facilitating safe and convenient cleaning. Moreover, in the preferred form of this alternative embodiment, the upper liner 120 includes a plurality of downwardly depending pegs 125. Conversely, the beverage support section 20 includes correspondingly positioned peg receiving holes 24. As such, it is seen that the downwardly depending pegs 125 of the upper liner 120 are structured to be matingly received into the peg receiving holes 24 of the beverage support section 20 so that the upper liner 120 can be removably secured to the beverage support section 20. Also in the preferred embodiment, the upper liner 120 may be constructed of a flexible and easily washable material such as vinyl, rubber, plastic, and the like. Moreover, the upper liner 120 may also include a containment portion 150, similar to that described above, and/or an overhanging portion 122 so as to direct accidentally spilled liquids away from the beverage blender 10.

In a preferred embodiment, best shown in FIG. 1, the beverage support section 20 is positioned a spaced-apart distance above a base section 30. The base section 30 is preferably shaped in a generally rectangular plate-like configuration, although other shapes may also be utilized. It is seen that the beverage support section 20 and base section 30 may be constructed of a wide variety of materials. Most preferably, however, both the base section 30 and the beverage support section 20 will be constructed of a lightweight and durable plastic material. In one alternative embodiment, however, the base section 30 may be substantially weighted so as to prevent undue horizontal movement of the beverage blender 10 during use, merely as a result of the weight of the base section 30. For example, the base section 30 may be weighted by securing it to a heavy plate constructed of lead, steel, or other heavy material. Alternatively, the base section 30 may itself be constructed of a dense and heavy material such as lead or steel, for example. In yet another embodiment, the base section 30 may be secured to a fixed underlying support surface such as a countertop utilizing standard fasteners, thereby preventing the beverage blender 10 from undergoing extensive movement during use.

In order to provide for effective blending, the beverage support section 20 and the base section 30 are structured and disposed to move/vibrate relative to one another. This is preferably accomplished by way of at least one support structure 40 disposed between the beverage support section 20 and the base section 30. In particular, the support structure 40 is configured to maintain the beverage support section 20 a predetermined distance above the base section 30 and to permit the beverage support section 20 to vibrate with respect to the base section 30. While a wide variety of different types of support structures 40 may be utilized, in a most preferred embodiment the support structure 40 is constructed of a rigid center shaft 42 surrounded by a compressed spring 44, as most clearly shown in FIGS. 1 and 4. The compressed spring 44 is located between the base section 30 and the beverage support section 20 and is structured to exert an upwards force on the beverage support section 20 in order to help maintain it in a spaced-apart distance above the base section 30. Indeed, the center shaft 42 of the support structure 40 may simply be a long bolt extending through apertures in the beverage support section 20 and the base section 30 and secured in place by standard fasteners, such as a nut 46, for example, as shown in FIG. 1. To provide increased stability, a support structure 40 is preferably positioned at each corner of the beverage support section 20, such that a total of four support structures 40 are utilized in the beverage blender 10. Naturally, however, fewer or even a greater number of support structures 40 may be utilized without departing from the present invention.

The beverage blender 10 preferably includes a first and second pair of substantially parallel side walls 110 and 115 as shown in FIGS. 2 and 3. The side walls 110 and 115 are structured to extend from the base section 30 to the beverage support section 20. Also, in a preferred embodiment, the side walls 110 and 115 extend substantially towards the beverage support section, as shown in FIG. 2, but do not contact the beverage support section 20. As such, the beverage support section 20 is free to vibrate with respect to the base section 30.

In order to vibrate the beverage support section 20, the beverage blender 10 of the present invention preferably includes at least one motor 60. In the preferred embodiment, however, a pair of motors 60 are utilized concurrently, as best shown in FIG. 1. Each motor 60 includes a rotating axle 65 and a small weight 62 secured thereto. Moreover, it is preferred that the weight 62 be positioned so that the axle 65 extends through an off-center position thereof. As such the rotation of the weight 62 in such an unbalanced and off-center position with respect to the axle 65 results in a vibration of the motor that in turn causes the beverage support section 20, to which it is secured, to undergo quick oscillating movements so that it vibrates relative to the base section 30. Further, in the preferred embodiment, wherein the second motor 60 is structured to be utilized concurrently with the first motor 60, the axles of each of the motors 60 are preferably generally aligned with one another and are structured to rotate in opposite directions from one another. As such, the rotation of the axles provides a high frequency, low turbulence vibration of the beverage support section 20 relative to the base section 30, which effectively mixes the contents of the beverage container 70 without excessively agitating the fluid and leading to a run over of fluid. Along these lines, the rotation of the axles in opposite directions functions to substantially stabilize and balance the oscillating and vibratory movement of the beverage support section 20, therefore reducing the chances of splashing or spilling of the liquid contents of the beverage container 70 positioned on the beverage support section 20.

The beverage blender 10 also preferably includes an actuation switch 80 structured to selectively turn the beverage blender 10 on or off. Of course, a wide variety of known switches may be utilized for this purpose without departing from the present invention. Alternatively, however, the beverage blender 10 may be equipped with a weight-sensitive actuation switch 80 which is structured to automatically turn the beverage blender 10 on when a weight equivalent to a substantially filed beverage container 70 is detected. Conversely, when the beverage container 70 is removed, the actuation switch 80 is configured to turn off the beverage blender 10.

In the present invention, the beverage blender 10 also preferably includes control means 90. The control means 90 are structured to enable a user to regulate the intensity of the vibratory movement of the beverage support section 20. The control means 90 may include a dial, for example, with various settings which correspond to differing motor 60 speeds. In this regard, it is seen that lowering the motor 60 speed results in a lower frequency vibration of the beverage support section 20. Such a lower motor 60 speed, however, will typically result in more turbulent movement of the liquid contents of the beverage container 70. Accordingly, by providing the beverage blender 10 with control means 90, a user is able to adjust the speed of the motors 60 so as to achieve any desired combination of vibration frequency and beverage turbulence.

Figure 5:
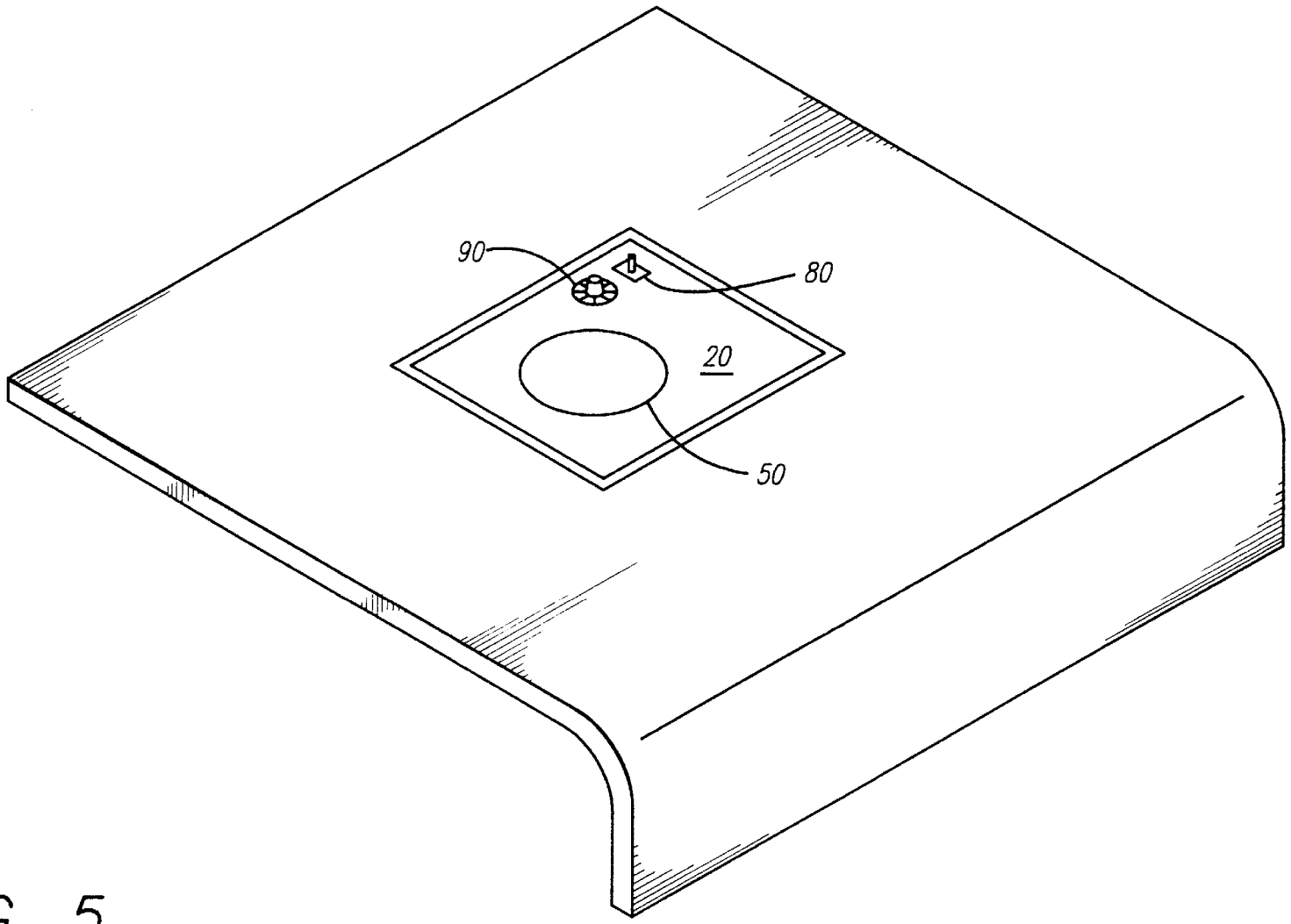
FIG. 5 is a perspective view of a fourth alternative embodiment of the present invention showing the beverage blender mounted and secured to a countertop so that the beverage support section is flush with a top surface of the countertop.

As indicated, the beverage blender 10 of the present invention may be constructed in a variety of portable and or fixed configurations. For example, in a preferred embodiment, the beverage blender 10 is structured to be an easily portable and self-contained unit as shown in FIGS. 1–4 and 6. As such, the beverage blender 10 can be utilized by simply placing it on top of a countertop, desk, or ledge, for example, and connecting it to a power supply. In another embodiment, however, the beverage blender 10 may be configured more as a built-in appliance, as shown in FIG. 5. In this embodiment, the beverage blender 10 includes mounting means structured to be secured to a standard countertop so that the top of the beverage support section 20 of the beverage blender 10 is flush with the top of the countertop, thereby saving valuable space on the countertop while also giving the beverage blender 10 the appearance of a luxury built-in kitchen appliance. Of course, a variety of known mounting means may be utilized for this purpose. For example, a pair of "L" brackets may be utilized with standard fasteners in order to secure the beverage blender 10 in place.

Figure 6:
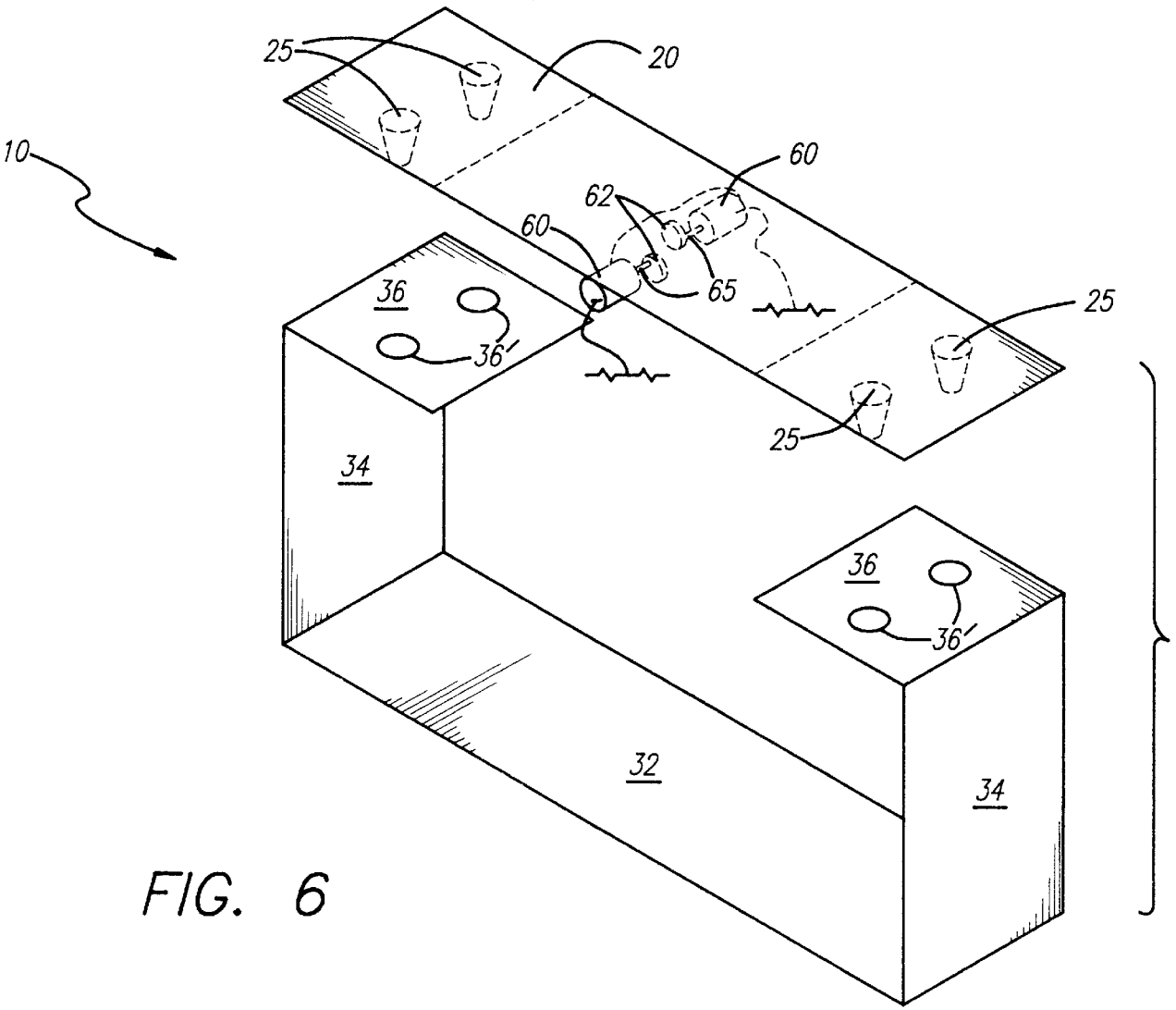
FIG. 6 is a fifth alternative embodiment of the beverage blender wherein the beverage support section is mounted directly on a rigid base section.

An alternative embodiment of the beverage blender 10 is shown in FIG. 6. In this embodiment, the base section 30 is substantially rigid and includes a bottom plate 32, a pair of side walls 34, and a pair of support ledges 36. The side walls 34 are preferably substantially parallel to each other and extend upwardly from the bottom plate 32. In this embodiment, the ledges 36 are disposed at the top of the side walls 34 and preferably extend in a generally horizontal direction so as to support the beverage support section 20 thereon. To provide for effective coupled engagement between the beverage support section and the base section 30, the beverage support section 20 preferably includes a plurality of downwardly depending pegs 25. Similarly, the support ledges 36 of the base section 30 s preferably include a plurality of peg receiving holes 36' disposed therein. As such, the plurality of downwardly depending pegs 25 are structured to be matingly received into the peg receiving holes 36'. In this regard, it is preferred that a rubberized or resilient material gasket be defined between the pegs 25 and the holes 36' so that the beverage support section 20 is free to vibrate relative to the support ledges 36 of the base section 30. Moreover, such an engagement will provide a certain degree of dampening and/or isolation of the vibration. Additionally, it is also noted that this embodiment facilitates removal of the beverage support section 20 from the base section in order to effectuate rapid cleaning.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A beverage blender comprising:

a beverage support section, a base section, said beverage support section disposed in a spaced-apart, generally horizontal relation above said base section, at least one support structure disposed between said beverage support section and said base section, said support structure maintaining said beverage support section in said spaced-apart relation above said base section and permitting relative movement between said beverage support section and said base section, a containment portion disposed on said beverage support section and structured to retain a beverage container thereon, at least a first motor and a second motor cooperatively disposed with said beverage support section, an axle of said first motor and an axle of said second motor being structured to rotate in opposite directions from each other so as to vibrate said beverage support section in relation to said base section in a substantially stable and balanced manner, and so as to correspondingly vibrate the beverage container disposed thereon and thoroughly blend a contents of the beverage container, and powering means structured to provide operating power to said first and second motors.

2. A beverage blender as recited in claim 1 including an off-center weight secured to said axle of at least said first motor such that the rotation of said axle of said first motor causes said beverage support section to vibrate relative to said base section.

3. A beverage blender as recited in claim 1 wherein said axles of said first motor and said second motor are generally aligned with one another.

4. A beverage blender as recited in claim 1 wherein said support structure comprises:

a bolt extending from said beverage support section to said base section, and a spring disposed about said bolt and structured to exert an upwardly biased force on said beverage support section so as to maintain said beverage support section in said spaced-apart position above said base section and permit said beverage support section to vibrate relative to said base section.

5. A beverage blender as recited in claim 4 further including four support structures.

6. A beverage blender as recited in claim 1 further including mounting means for securing said beverage blender to a countertop.

7. A beverage blender as recited in claim 6 wherein said mounting means are structured to secure said beverage blender to said countertop such that said beverage support section of said beverage blender is flush with a top of said countertop.

8. A beverage blender as recited in claim 1 wherein said containment portion includes a ring structured to extend upwardly from said beverage support section and retain the beverage container therein.

9. A beverage blender as recited in claim 1 wherein said containment portion includes an indentation in said beverage support section structured to retain the beverage container thereon.

10. A beverage blender as recited in claim 1 further including an actuation switch structured to permit a user to selectively turn said beverage blender on or off.

11. A beverage blender as recited in claim 1 further including a weight-sensitive actuation switch structured to automatically turn said beverage blender on when a weight substantially equivalent to the beverage container in a filled state is exerted on said beverage support section, and automatically turn said beverage blender off when said weight substantially equivalent to the beverage container in said filled state is removed from said beverage support section.

12. A beverage blender as recited in claim 1 further including control means structured and disposed to permit a user to regulate an intensity of said vibration of said beverage support section.

13. A beverage blender as recited in claim 1 wherein said base section is substantially heavy so as to prevent undue horizontal movement of said beverage blender during use.

14. A beverage blender as recited in claim 1 further including:

a first pair of substantially parallel side walls structured to extend from said base section towards said beverage support section, and a second pair of substantially parallel side walls structured to extend from said base section towards said beverage support section.

15. A beverage blender as recited in claim 1 wherein said beverage support section includes an overhanging portion disposed at an outer perimeter of said beverage support section and structured to direct any accidental spillage away from an interior region of said beverage blender.

16. A beverage blender comprising:

a beverage support section and a base section, said beverage support section being structured to support a beverage container thereon, said base section including at least one upwardly extending side wall, and at least one support ledge positioned generally at a top of said side wall and extending in a generally horizontal direction, said beverage support section structured to be supported on said ledge of said base section such that said beverage support section is permitted to vibrate relative to said base section, at least a first motor and a second motor cooperatively disposed with said beverage support section, an axle of said first motor and an axle of said second motor being structured to rotate in opposite directions from each other so as to vibrate said beverage support section in relation to said base section in a substantially stable and balanced manner, and so as to correspondingly vibrate the beverage container disposed thereon and thoroughly blend a contents of the beverage container, and powering means structured to provide operating power to said first and second motors.

17. A beverage blender as recited in claim 16 including an off-center weight secured to said axle of at least said first motor such that a rotation of said axle of said first motor causes said beverage support section to vibrate relative to said base section.

18. A beverage blender as recited in claim 16 wherein said axles of said first motor and said second motor are generally aligned with one another.

19. A beverage blender as recited in claim 16 wherein:

said beverage support section includes at least one downwardly depending peg, said support ledge of said base section includes at least one peg receiving holes therein, and said downwardly depending peg is structured to be matingly received into said peg receiving hole such that said beverage support section is free to vibrate relative to said support ledge of said base section.

20. A beverage blender comprising:

a beverage support section and a base section, said beverage support section disposed in a spaced-apart generally horizontal relation above said base section, at least one support structure disposed between said beverage support section and said base section and structured to support said beverage support section in said spaced-apart distance above said base section so as to permit said beverage support section to vibrate relative to said base section, said support structure being secured to said beverage support section and said base section, at least a first motor and a second motor, an axle of said first motor and an axle of said second motor being structured to rotate in opposite directions from each other so as to vibrate said beverage support section in relation to said base section in a stabilized and balanced manner, an upper liner structured to be removably secured on top of said beverage support section, said upper liner including a containment portion disposed therein and structured to retain a beverage container thereon, powering means structured to provide operating power to said first and second motors.

21. A beverage blender as recited in claim 20 wherein:

said beverage support section includes a plurality of peg receiving holes therein, said upper liner includes a plurality of downwardly depending pegs structured to be matingly received into said peg receiving holes of said beverage support section.

22. A beverage blender as recited in claim 20 including an off-center weight secured to said axle of at least said first motor such that the rotation of said axle of said first motor causes said beverage support section to vibrate relative to said base section.

23. A beverage blender as recited in claim 20 wherein said axles of said first motor and said second motor are generally aligned with one another.

* * * * *